United States Patent [19]

Florjancic

[11] Patent Number: 5,046,628

[45] Date of Patent: Sep. 10, 1991

[54] DEVICE FOR HOLDING DRINKING STRAWS

[76] Inventor: Peter Florjancic, Isarstrasse 25, 8901 Wallau, Fed. Rep. of Germany

[21] Appl. No.: 421,243

[22] Filed: Oct. 13, 1989

[30] Foreign Application Priority Data

Oct. 14, 1988 [DE] Fed. Rep. of Germany ..... 8812923
Nov. 21, 1988 [DE] Fed. Rep. of Germany ..... 8814485

[51] Int. Cl.[5] ..... A47G 19/22; A47G 21/18; A47G 23/00

[52] U.S. Cl. ..... 215/100 R; 215/1 A; 220/85 D

[58] Field of Search ..... 215/1 A, 100 R, 101, 215/228, 229; 220/85 D; 229/906.1

[56] References Cited

U.S. PATENT DOCUMENTS

| | | | |
|---|---|---|---|
| 344,567 | 6/1886 | Coleman | 215/100 R |
| 1,735,144 | 11/1929 | Tanner | 215/100 R |
| 2,070,495 | 2/1937 | Strutz et al. | 215/100 R |
| 2,109,750 | 3/1938 | Paul | 215/228 X |
| 2,378,660 | 6/1945 | Roux . | |
| 2,469,292 | 5/1949 | Cornwell | 215/100 R |
| 2,489,875 | 11/1949 | Embree | 220/85 D X |
| 2,557,411 | 6/1951 | Butsch | 215/100 R X |
| 2,787,395 | 4/1957 | Florio | 215/100 R |
| 4,775,060 | 10/1988 | Pinney | 215/100 R |
| 4,850,495 | 7/1989 | Wallace | 215/1 A X |

FOREIGN PATENT DOCUMENTS 967291 10/1950 France .

*Primary Examiner*—Sue A. Weaver
*Attorney, Agent, or Firm*—Dilworth & Barrese

[57] ABSTRACT

The invention relates to a drinking straw holder having a base element provided with side portions serving as holding elements which are mounted on the side thereof via joints. In the inoperative state, the side portions and the base element are essentially located in one plane, but can be folded into a three-dimensional shape of use and application and placed onto the rim for a receptacle.

14 Claims, 1 Drawing Sheet

DEVICE FOR HOLDING DRINKING STRAWS

BACKGROUND OF THE INVENTION

Drinking straws for the suction of beverages out of glasses, cups or similar drinking receptacles have in the form they normally and particularly arise in the trade, a length of more than 200 mm, so that they can only be used in drinking receptacles of the corresponding height without the danger of them falling out. If the drinking receptacle, denoted for the simplification of the description as a "glass" in the following, is too low, the drinking straw must be put down beside the vessel. For hygienic reasons, this is often undesirable, also impractical and, in many cases, impossible, as, for example, for the sick confined to bed or with a hand or arm injury, but also then when one wishes to consume the drink whilst standing away from a table or other possible places for depositing the straw. Besides, for sufficiently deep glasses, the drinking straw which moves freely or turns within the glass must be guided to the mouth by the free hand which does not hold the glass. This difficulty is greater when the rules require that a drink is to be consumed with more than one drinking straw.

For this purpose, a holder for a drinking straw is already known from U.S. Pat. 2,070,495 which is so formed that it can be placed on upper rim of the receptacle. The holder is molded such that a receiving opening for the drinking straw is provided on the upper free end. This holder is preformed in its final shape of application.

Further variants of such a holder are disclosed in FR Patent No. 967,291, U.S. Pat. No. 4,775,060 and U.S. Pat. No. 2,378,660.

SUMMARY OF THE INVENTION

It is an object of the invention to provide a device for holding drinking straws which, for simple manufacture and with a simple construction, is easily bandleable and easily and quickly mountable on the vessel.

This object is solved according to the invention by a device for holding drinking straws on and in drinking receptacles in a defined position, comprising a base element and a first holding element for holding the drinking straw and a second holding element for holding a base element on the drinking receptacle. The holding elements are side portions arranged substantially in a plane with the base element. The side parts are foldable into their position of use and application about joints connected with the base element. A receiving recess for the drinking straw on the rim of the drinking vessel is arranged in each of the side portions.

In its prefabricated non-used state, this device is essentially a flat two-dimensional form which can be made into a three-dimensional form (shape for application) by bending the side portions about the mentioned joints. This three-dimensional form is then applied on the upper rim of the receptacle. Therefore, the device is easily and conveniently stored in its non-used state but can be equally as easily formed into its shape for application and use by the appropriate bending thereof.

Preferably, a side portion is respectively arranged as a second holding element on each of the two sides of the base element, and on the side edge therebetween, a side portion is arranged as the first holding element. Consequently, these side portions can be simultaneously bent with one hand, if necessary, so that a simple one-handed placement thereof upon the receptacle rim is possible.

For the simplification of placement, the side portions formed as the second holding elements can preferably be locked together in their position of application and use with the side portion formed as the first holding element. Through this locking engagement, the device remains in its shape for application and can be very simply placed onto the receptacle rim. In addition, it is easier to apply the drinking straw in this state.

Suitably, in the side portion formed as the second holding element, a wide recess is formed in which a flap is connected on one side to the side portion and which forms a slit with one edge of the recess for receiving the drinking receptacle rim. This makes possible the placing of the device on receptacles of various sizes, i.e. for various circumferences and different wall thicknesses.

Preferably, the flap is more flexible than the associated side portion to further simplify the application of the holder onto the receptacle rim.

For reasons of simplicity, the device is preferably a single injection molded plastic part (see FIG. 4). In order that drinking straws of various diameters or several straws can be mounted, several differently sized recesses for receiving the various sized drinking straws are arranged in the side portion formed as the first holding element.

Finally, the free end of the side portion formed as the first holding element can be arranged with an outwardly tapering arrow shape.

BRIEF DESCRIPTION OF THE DRAWINGS

An example of the invention is illustrated in the schematic drawings and is described by reference to these drawings in which.

DESCRIPTION OF THE PREFERRED EMBODIMENTS

Figure 1:
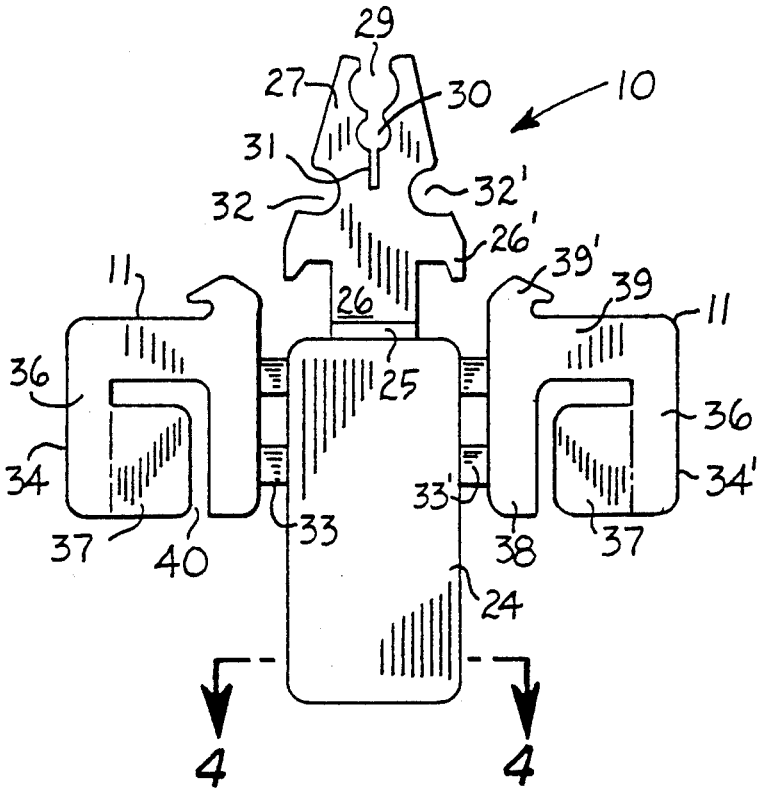
FIG. 1 is a simple exemplified embodiment of a drinking straw holder.
Figure 2:
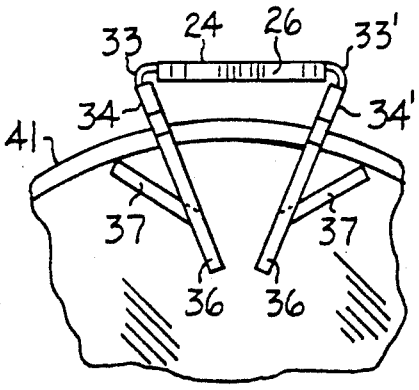
FIG. 2 is a plan view of the embodiment shown in FIG. 1 in its position of application and use fixed on a glass.
Figure 4:
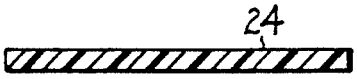
FIG. 4 is a sectional view along line 4—4 of FIG. 1.

In the exemplified embodiment shown in FIGS. 1 and 2, the drinking straw holder is an essentially flat injection molded plastic part 10 in its non-used state. The part 10 consists of a rectangular angled or somewhat rectangular plate 24 and two side portions 34 and 34' connected with the plate 24 via links (joints) 33 and 33' which are thinner than the plate and the side portions. In a similar manner, a holding tongue 26 also formed as a side portion is connected with a narrower edge of the plate 24 via a link 25 weaker than the plate.

The holding tongue 26 is provided with openings 29, 32, 32' of various diameters for the placing therethrough of a drinking straw and which are suitably dimensioned so that a drinking straw of a usual diameter can only just be guided therethrough without difficulty. The holding tongue 26, which is narrower on its side facing the plate 24 than the narrow side of the plate, then changes over into a somewhat arrow-shaped part 27. The holding tongue 26 has at its point an opening 29 for a drinking straw of normal size and, proceeding from this opening, a further opening 30 for a drinking straw of smaller diameter. Furthermore, a slit 31 for clasping the thread of a tea bag opens into the opening 30. As shown in the exemplified embodiment according to FIG. 1, for drinks to be particularly consumed with several drinking straws, further openings 32, 32' are formed in the sides of the arrow-shaped tongue portion.

Mounted to both sides of the plate 24 connected with it via the thin links 33, 33' are the side portions 34, 34' functioning as clasp elements to form a U-shaped frame 36, 38, 39. In the U-shaped frame 36, 38, 39, a flap 37 thinner than the frame 36, 38, 39 is respectfully connected with each outwardly lying leg 36 , the flaps forming an attaching slit 40 together with the inner edge of the inner leg 38 and the leg connection 39.

When both the side portions 34, 34' are inwardly pressed together with the thumb and index finger and the holder is then pushed onto the rim of the glass 41 via the slits 40 according to FIG. 2, the flaps 37 thinner than the frame 36, 38, 39 of the side portions automatically bent outwardly and clasp the rim of the glass between their outer edges and the inner edge of the inner leg 38 and thus keep the holder firmly on the glass.

In addition, the side portions to the side of the plate and the tongue can be extended by a triangular hook-shaped projection 39' which extend above their upper edges 11. In the case that the tongue 26 is also provided with a hook-shaped projection 26', these projections may then act together as described below. In this case the holding tongue 26 suitably consists of a further link-like weak-point 25 and is divided in this manner into a lower bendable catching portion and an upper portion freely bendable with respect to the lower portion and provided with openings 27 for the drinking straw.

Figure 3:
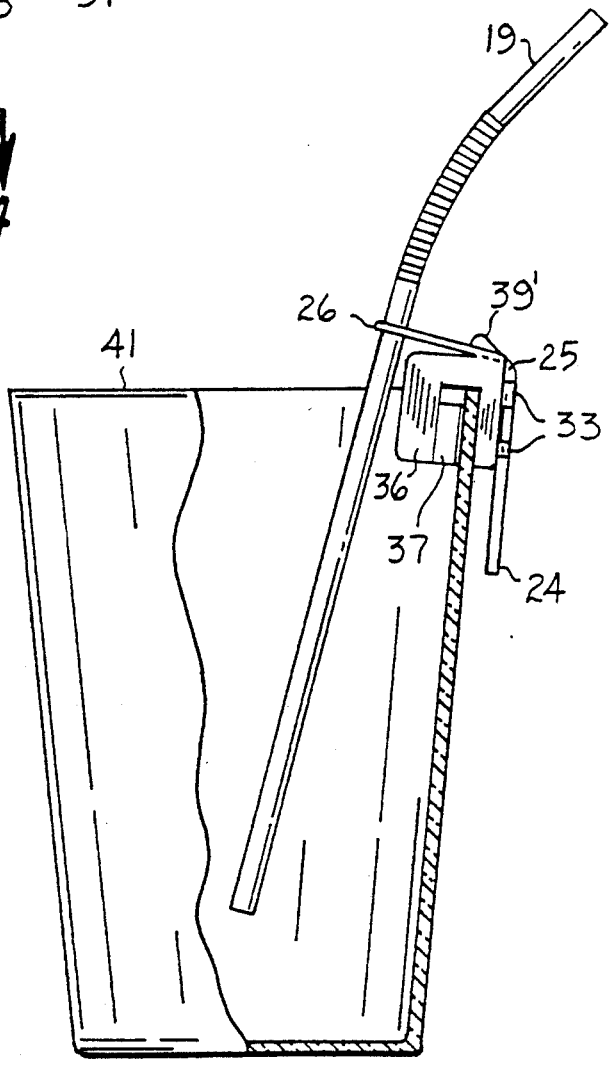
FIG. 3 shows a drinking receptacle with a holder in its mounted condition holding a drinking straw.

For use, the side portions 34, 34' are bent about the links 33, 33' away from the outer side of the plate 24 and the device is then placed on the glass 41 according to FIG. 3 so that the glass engages with the slits 40. Since the flaps 37 are thinner than the side portions 34, 34', these bend themselves outwardly according to FIG. 2 and rest against the inside of the glass rim. As a result of this spreading of the flaps, glass thicknesses and various receptacle sizes can therefore be considered and a firm lodgement of the device is ensured.

The correct direction for the bending of the side portions can be indicated, for example, in that an inprint "outside" is applied onto the plate 24, or this surface may be used for the printing thereon of an advertisement. For the use of the inventive device in hospitals, health resorts and similar institutions, the visible free surface of the plate can also be used for the application of the name of the patient.

Following this, the tongue 26 is bent in the direction of the opening of the glass 41 about the link 25 as according to FIG. 3 and the drinking straw 19 is pushed through the opening 29 as far into the inside of the glass as required by the user. When the drinking straw is consequently released, this then tilts in the opening 29 as a result of the elastic spring-effect of the tongue and becomes firmly clasped. In addition, with the aid of the projections 26', 39' which have engaged with one another, the tongue 26 is fixed (locked) with the side portions 34, 34' in a certain position.

I claim:

1. Device for holding a drinking straw on and in a drinking receptacle in defined position, comprising a base element, a first holding element for holding the drinking straw, and a second holding element for holding said base element on the drinking receptacle, wherein the first and second holding elements are side portions arranged substantially in a plane with the base element, the side portions being mounted upon said base element to be foldable into position for use and application about joints connected to the base element, means for folding said side portions about said joints into position for use, and a recess is arranged in each of the side portions, said recess in said first side portion being arranged to receive the drinking straw and said recess in said second side portion being arranged to receive a rim of the drinking receptacle, wherein said base element comprises three sides, and additionally comprising a side portion arranged as a third holding element for holding said base element on the drinking receptacle, said second and third holding elements arranged on two sides of the base element and on a side of said base element therebetween, said first holding element is arranged.

2. Device according to claim 1, wherein the side portions arranged as the second and third holding elements are lockable in position for use and application together with the side portion arranged as the first holding element, and additionally comprising means for locking said first holding element and said second and third holding elements together into position for use.

3. Device according to claim 1, which is a single injection molded plastic part.

4. Device according to claim 1, wherein several differently sized recesses for receiving variously sized drinking straws are formed in the side portion arranged as the first holding element.

5. Device according to claim 1, wherein the side portion arranged as the first holding element tapers outwardly in an arrow shape at a free end thereof.

6. Device according to claim 1, which is a single injection molded part.

7. Device according to claim 1, wherein said first, second and third holding elements are mounted on different sides of said base element in unfolded condition.

8. Device according to claim 1, wherein said recess is arranged in said first holding element while in planar condition.

9. Device according to claim 1, wherein said second holding element comprises said respective recess being formed therein separate and apart from said base element.

10. Device for holding a drinking straw on and in a drinking receptacle in defined position, comprising a base element, a first holding element for holding the drinking straw, and a second holding element for holding said base element on the drinking receptacle, wherein the first and second holding elements are side portions arranged substantially in a plane with the base element, the side portions being mounted upon said base element to be foldable into position for use and application about joints connected to the base element, means for folding said side portions about said joints into position for use, and a recess is arranged in each of the side portions, said recess in said first side portion being arranged to receive the drinking straw and said recess in said second side portion being arranged to receive a rim of the drinking receptacle, additionally comprising a side portion arranged as a third holding element for holding said base element on the drinking receptacle, a recess formed in the side portion arranged as the third holding element, and a flap being connected on one side thereof with the respective side portion in the respective recess in said second and third holding elements and which forms a slit with an edge of the respective recess for receiving the rim of the drinking receptacle.

11. Device according to claim 10, wherein the flap is more flexible than the associated side portion.

12. Device for holding a drinking straw on and in a drinking receptacle in defined position, comprising a base element, a first holding element for holding the drinking straw, and a second holding element for holding said base element on the drinking receptacle, wherein the first and second holding elements are side portions arranged substantially in a plane with the base element, the side portions being mounted upon said base element to be foldable into position for use and application about joints connected to the base element, means for folding said side portions about said joints into position for use, and a recess is arranged in each of the side portions, said recess in said first side portion being arranged to receive the drinking straw and said recess in said second side portion being arranged to receive a rim of the drinking receptacle, wherein said base element comprises three sides, and additionally comprising a side portion arranged as a third holding element for holding said base element on the drinking receptacle.

said second and third holding elements arranged on two sides of the base element and on a side of said base element therebetween, said first holding element is arranged, wherein the side portions arranged as the second and third holding elements are lockable in position for use and application together with the side portion arranged as the first holding element, and additionally comprising means for locking said first holding element and said second and third holding elements together into position for use, wherein said locking means comprise hook-shaped projections mounted on each of said first, second and third holding elements for interlocking said first holding element with said second and third holding elements.

13. Device for holding a drinking straw on and in a drinking receptacle in defined position, comprising a base element, a first holding element for holding the drinking straw, and a second holding element for holding said base element on the drinking receptacle, wherein the first and second holding elements are side portions arranged substantially in a plane with said base element, the side portions being mounted upon said base element to be foldable into position for use and application about joints connected to the base element, means for folding said side portions about said joints into position for use, and a recess is arranged in each of the side portions, said recess in said first side portion being arranged to receive the drinking straw and said recess in said second side portion being arranged to receive a rim of the drinking receptacle, comprising an additional joint link interconnecting said second holding element with said base element.

14. Device for holding a drinking straw on and in a drinking receptacle in defined position, comprising a base element, a first holding element for holding the drinking straw, and a second holding element for holding said base element on the drinking receptacle, wherein the first and second holding elements are side portions arranged substantially in a plane with the base element, the side portions being mounted upon said base element to be foldable into position for use and application about joints connected to the base element, means for folding said side portions about said joints into position for use, and a recess is arranged in each of the side portions, said recess in said first side portion being arranged to receive the drinking straw and said recess in said second side portion being arranged to receive a rim of the drinking receptacle, wherein the side portion arranged as the first holding element tapers outwardly in an arrow shape at its free end, and wherein said recess arranged in said first holding element is positioned at said free end of said first holding element.

* * * * *